United States Patent [19]

Hickman et al.

[11] 4,195,456

[45] Apr. 1, 1980

[54] INSULATED BASEMENT WINDOW ASSEMBLY

[75] Inventors: John S. Hickman, Milwaukee; Andrew P. Jensen, Madison, both of Wis.

[73] Assignee: Capital Steel & Supply Co., a Division of Jensen Investment Corp., Madison, Wis.

[21] Appl. No.: 844,100

[22] Filed: Oct. 20, 1977

[51] Int. Cl.[2] ..... E06B 3/00

[52] U.S. Cl. ..... 52/208; 52/213; 52/404

[58] Field of Search ..... 52/204, 208, 213, 202, 52/169.14, 404, 309.12, 206, 475, 616, 267, 269

[56] References Cited

U.S. PATENT DOCUMENTS

| | | | |
|---|---|---|---|
| 2,074,874 | 3/1937 | Vogel | 52/269 X |
| 2,984,299 | 5/1961 | Vallarelli et al. | 160/26 |
| 2,999,279 | 9/1961 | Laues . | |
| 3,191,240 | 6/1965 | Slaman et al. | |
| 3,239,977 | 3/1966 | Shore | 52/204 |
| 3,352,060 | 11/1967 | Thams | 49/192 |
| 3,822,462 | 7/1974 | Chubb | 52/208 |
| 3,861,444 | 1/1975 | Portwood | 49/501 X |
| 3,868,789 | 3/1975 | Gates | 49/501 |
| 3,906,693 | 9/1975 | Todorovic | 52/404 |
| 3,940,898 | 3/1976 | Kaufman | 52/616 X |
| 4,044,520 | 8/1977 | Barrows | 52/309.12 |

*Primary Examiner*—Carl D. Friedman

*Attorney, Agent, or Firm*—Merrian, Marshall & Bicknell

[57] ABSTRACT

A leak-free, insulated basement window assembly which includes a prefabricated panel comprising an insulating member and impact resistant strip joined to the insulating member. The panel has a pre-cut opening which is adapted to be aligned with a window opening in a masonry basement wall. A plastic window unit, which serves as an insulating membrane, is inserted into the opening with the window unit being located adjacent the outer basement wall.

13 Claims, 5 Drawing Figures

FIG. 4
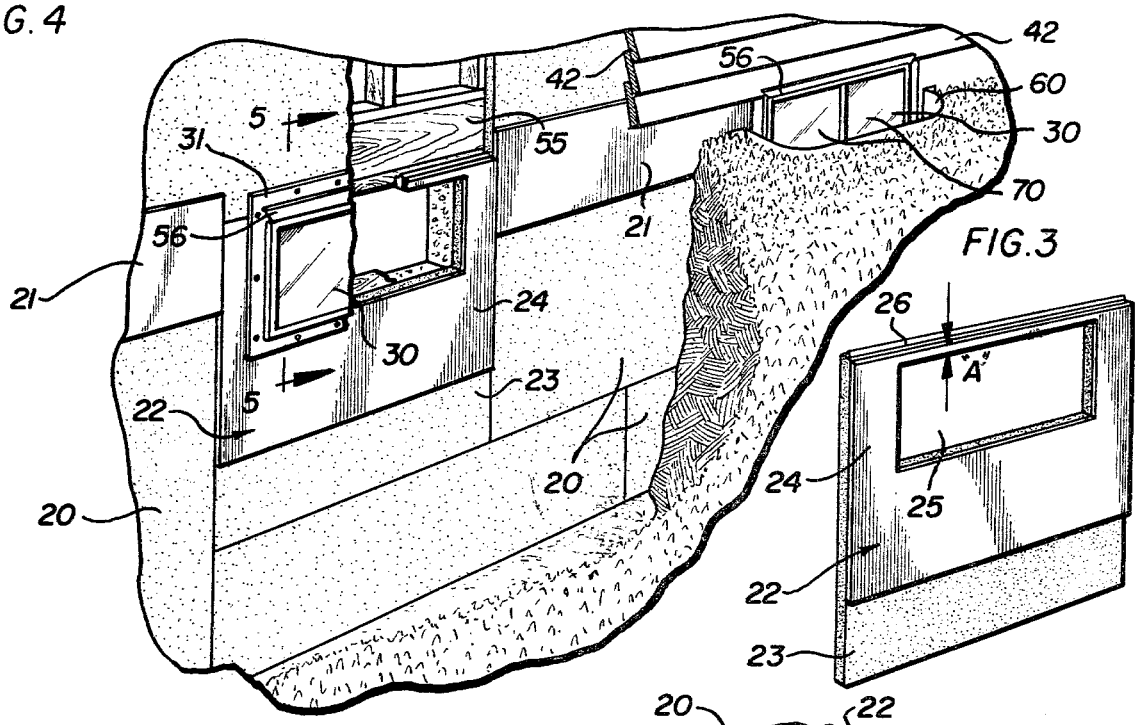
FIG. 3
FIG. 5
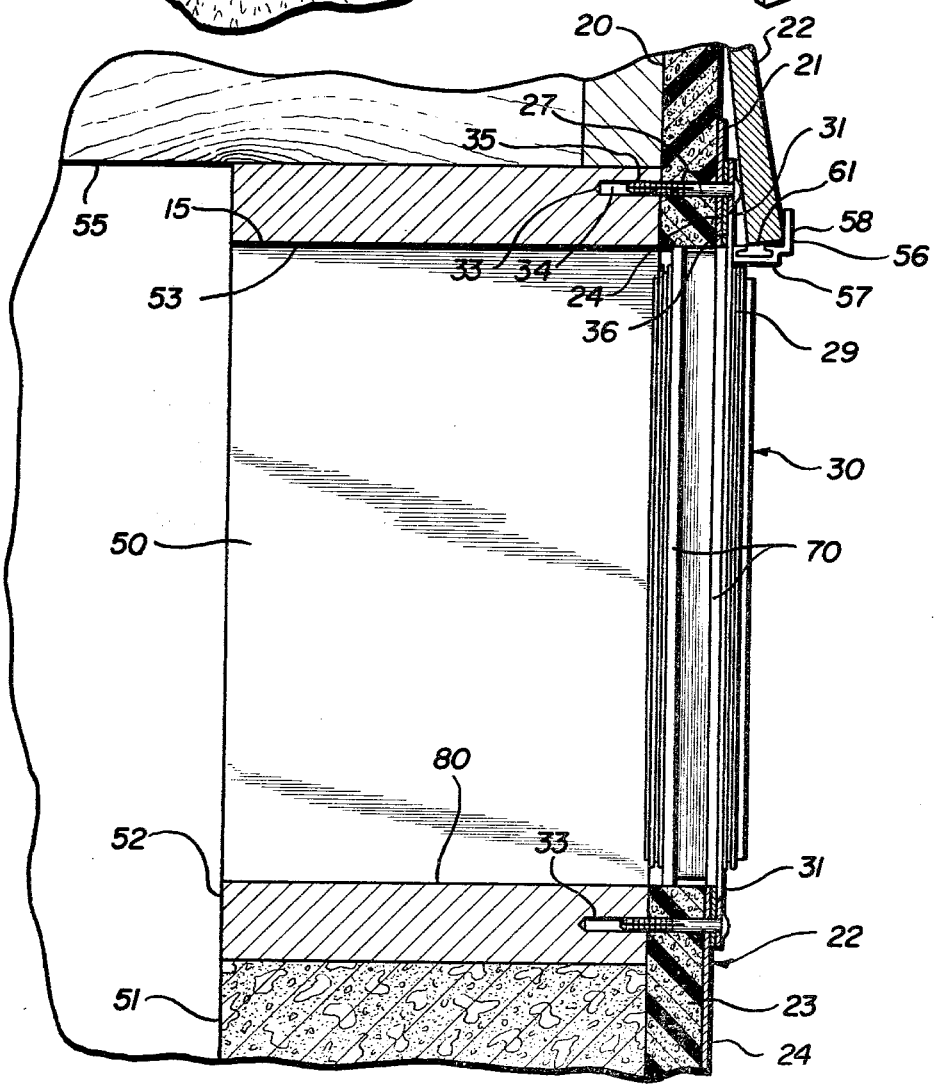

INSULATED BASEMENT WINDOW ASSEMBLY

The present invention relates to an improved basement window assembly for a home or industrial building. In general, the invention disclosed and claimed herein involves a window assembly which includes an insulating member adapted to be positioned on the outer basement wall at the location of a window opening. A strip of impact resistant material is joined to and positioned over the insulating member. A plastic window unit is fastened to a wooden form located in the window opening of the basement wall or to the masonry basement wall itself. Preferably, the insulating member and impact resistant strip are prefabricated for ease of installation at a job site. The window unit can be provided with a flashing fin located along the top of the window unit to receive the bottom portion of a conventional siding strip which is attached to the sides of a particular structure.

BACKGROUND OF THE INVENTION

In the construction of buildings, consideration has been given, particularly in recent years when the energy shortage has been recognized, to the insulating of basement walls for the purpose of reducing heat losses from inside the basement of a building. One solution to the problem of basement heat loss involves the use of insulating material in the form of sheets or panels. The insulating panels are positioned along the perimeter of the outer basement wall and extend downward either to the frost line or, if desired, to the foundation of the building. The insulating material will not absorb water so that the freezing and thawing cycles below the soil grade, which normally occur with changes of weather, will not adversely affect the properties of the insulating material.

The utilization of insulating material around the perimeter of the basement walls has served to maintain the heat within the basement of the building and thereby reduce heat loss which is desirable because the amount of fuel necessary to heat the basement of a building is reduced.

Unfortunately, the provision of the insulation material about the outer basement walls of a building has not reduced to problems of heat loss that occur in the vicinity of the window units normally found on basements of homes and other buildings. Conventional basement windows are positioned within formed openings in the masonry or concrete basement walls of a building. The window units often are made of a metal or wood frame having glass, plastic or screen inserts. Generally when the window unit is positioned in the opening formed for it, the unit is spaced inwardly from the outer basement wall in order that water will not leak around the openings or seam between the window unit and the masonry wall or wood form. Window assemblies presently known, however, have the disadvantage that they serve as a source of heat loss from a basement because of the relatively poor insulating characteristics of the window assembly.

What is desired is a basement window installation which serves to reduce heat losses in a basement, which normally occur at the window openings in the basement walls. The desired window installation must also be leak free so that water will not leak into the basement at the area of the window opening as this is entirely undesirable. Further, it is desired that the window assembly be readily and easily installed at a job or building site.

SUMMARY OF THE INVENTION

The invention disclosed and claimed herein involves a substantially leak-free, insulated basement window assembly which serves to reduce heat losses presently associated with conventional basement window installations. The installation of the present invention is substantially leak-free and provides increased insulation in the area where a window unit is located in a basement wall.

Briefly, the invention comprises an assembly which utilizes a layer of insulating material which is positioned on the outer basement wall surrounding a window opening in the concrete basement wall. Preferably, a strip of impact resistant material is joined to the insulating material by adhesive or other suitable fastening means and openings are cut in the strip and insulation member. The pre-cut openings are adapted to be aligned with a window opening in the basement wall. A plastic window unit is positioned within the aligned openings and is seated so that it is positioned adjacent the outer basement wall. The window unit which employs double panes of glazing serves as an insulating membrane across the window opening. The window unit installation can be installed relatively easily at a job or building site. Preferably, the insulation material and impact resistant strip are pre-fabricated prior to their arrival at a job site.

Additionally, where siding materials are employed, the window unit of the present invention is provided with a flashing fin which extends outward from the top of the window frame. Upon installation, the bottom of a siding strip can be inserted in the fin of the window unit to provide a self-flashed, leak-free lap and a desired appearance to the installation.

The insulated basement window assembly of the present invention permits the insertion of a window unit into an insulation envelope located on the outer or "weather-side" of a masonry basement wall. The window unit features a plastic frame with relatively high heat-flow resistance. Employing the window assembly of the present invention allows the basement masonry wall to be shielded against cold outdoor winds and temperatures. Shielding the basement wall in this manner serves to reduce thermal stress and wall cracking around a basement window opening, and, it also reduces heat loss around the window opening. Moreover, water or melting snow cannot seep down between the insulation and outer wall surface as the window unit is sealed to prevent water from reaching the junction between the insulation and the masonry wall.

BRIEF DESCRIPTION OF THE DRAWINGS

FIG. 3 shows a pre-fabricated panel comprising an insulating member and a flexboard strip joined to the insulating member with a pre-cut window opening formed in the panel;

FIG. 4 shows a partial perspective view of the leak-free, insulated basement window assembly of the present invention wherein the basement window opening in a masonry basement wall is located at the top of the basement wall; and, FIG. 5 shows a section view along lines 5—5 in FIG. 4.

DETAILED DESCRIPTION

Figure 1:
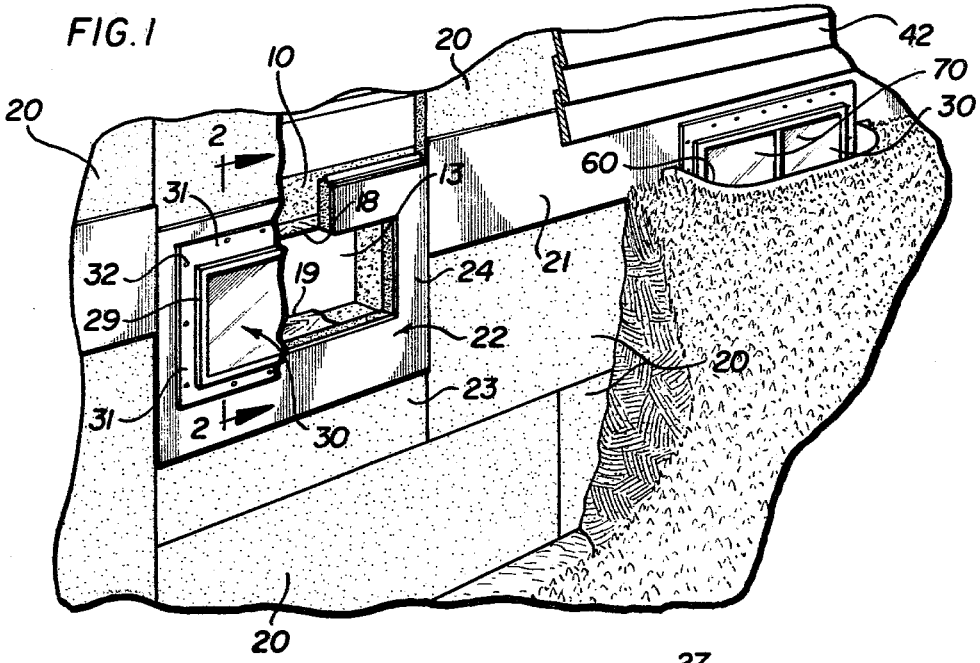
FIG. 1 shows a partial perspective view of the leak-free, insulated basement window assembly of the present invention wherein the basement window opening in the masonry basement wall is located below the top of the basement wall.
Figure 2:
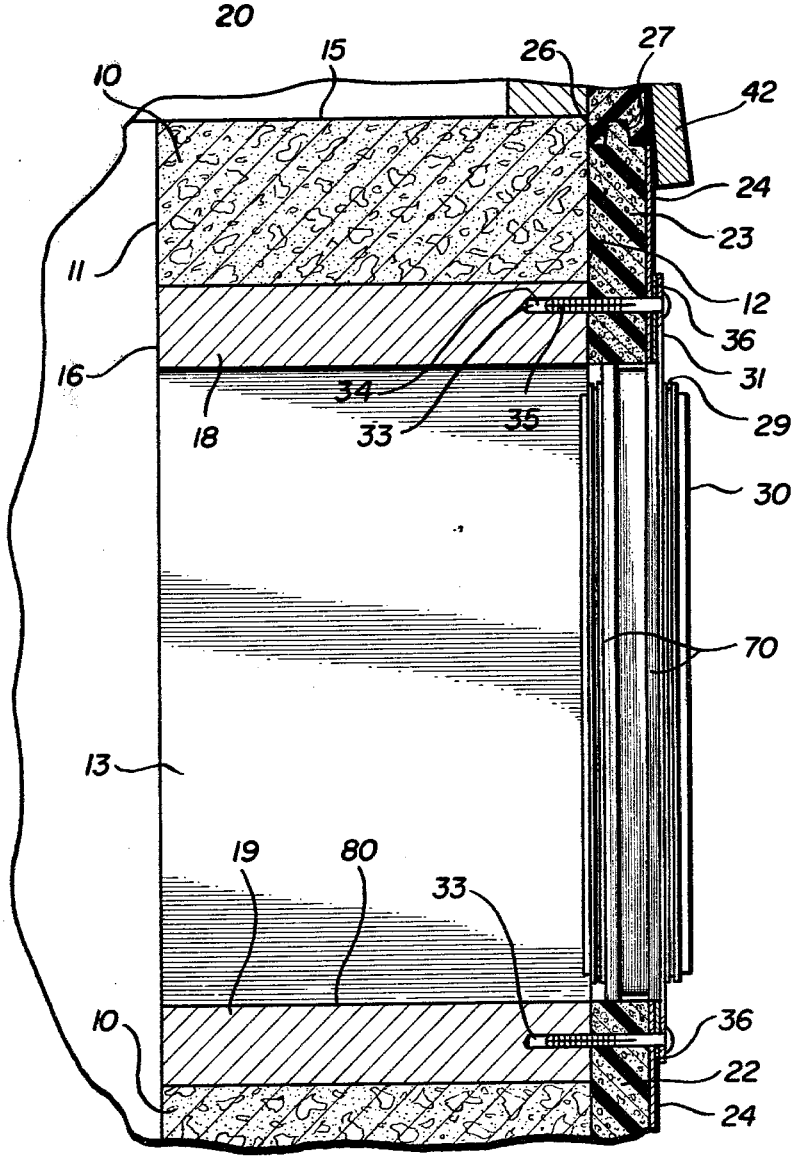
FIG. 2 shows a section view along lines 2—2 in FIG. 1.

Referring to FIGS. 1 and 2 of the drawings, there is shown a concrete basement wall 10 having inner and outer walls 11 and 12. Window opening 13 is located below the top 15 of basement wall 10. Wood form 16 surrounds the opening 13 and includes top and bottom wood members 18,19 and side members which are not illustrated.

As shown in FIG. 1, window opening 13 is located partially below the ground level of the building and for purposes of illustration, the ground has been cut away to expose the basement window assembly.

Insulation material in the form of insulation sheets 20 is located along the outer basement wall. Insulation sheets 20 also cover the sides of the building frame above ground. The sheets can be attached to the building frame and basement wall be adhesive or other suitable means. The sheets abut each other and the joints can be sealed as required. One insulation material that has been employed is a foam material known as STYROFOAM brand, manufactured by Dow Chemical Company U.S.A., and described in Dow's brochure identified as Form No. 179-7094-77. Another insulating material that can be employed, if desired, is a polystyrene bead board. One such board is manufactured by BASF Wyandott Corp., Parsippany, N.J., and is called STYROPOR, and described in the company's catalog entitled "Styropor-1976."

In order to protect the insulation material from damage against sunlight or impact from lawnmowers or other objects, a strip 21 of impact resistant material is joined to the insulation material. The height of the narrow strip of material is such that it covers insulation 20 from at least the underside of siding 42, FIG. 1, to a distance slightly below grade level. One strip member which has been employed is an inert, stable cement asbestos board having superior impact resistance and a relatively high cement content manufactured by Johns Manville and known as FLEXBOARD. The FLEXBOARD material is described in Johns Manville flyer, Form BSD-23A 12-74.

The window assembly at the location of opening 13 includes a pre-fabricated panel 22, FIG. 3, which includes insulation member 23 and an impact resistant strip 24 affixed to member 23 by an adhesive or any other suitable fastening means. Strip 24 does not entirely cover insulating member 23 because when the panel is installed at a job site, the lower portion of the insulation will be covered by the grade which is deposited against the insulated basement wall.

Window opening 25 is preferably cut in panel 22 at the factory so that it will, upon installation at the job site, be aligned with window opening 13 in the basement wall.

In assembly, panel 22 is positioned against and joined by adhesive to outer basement wall 12. Insulating member 23 has a tongue 26 on its top wall which is adapted to fit within groove 27 located on the bottom wall of the insulating member 20 positioned adjacent the top of member 23.

After pre-fabricated panel 22 has been installed, a window unit 30 is inserted in the openings 13 and 25 as seen more clearly in FIG. 2. Window unit 30 comprises a plastic frame 29 which includes a plastic mounting flange 31 which extends along the top, bottom and sides of window unit 30. Window unit 30 includes dual panes of shatterproof acrylic safety glazing 70. Plastic window units which have been found suitable for the insulated basement window assembly of the present invention are available from the Plyco Corporation, Elkhart Lake, Wisconsin 53020. The units are known as the "Protectowall" window units, size nos. 32"×16" and 32"×12".

Flange 31 has openings 32 for the receipt of fastener members 33 which include a metal rivet 34 disposed within a split plastic sheath 35. Fastener members 33 are driven into the wood form 16 or, in the event a wooden form is not employed, the fasteners can be driven into the concrete wall. Any suitable fastener member can be employed, however, one fastener that has been utilized is available from J. D. Sales Company, New Berlin, Wis. and bears that company's catalog number 5860, ¼"×2" M.D. "Nylon Tapits."

Sealing material 36 is deposited on panel 22 at the location where flange 31 of window unit 30 seats against panel 22 to insure that no leakage occurs between the window unit 30 and the panel 22. While any suitable sealant can be employed, a sealing material that has been found satisfactory is known as Geocel Water Seal 100, manufactured by Geocel Limited, Inc., Elkhart, Ind., and is described in Geocel's brochure, Form No. C-WS 100-976.

Window opening 13 is shown in FIGS. 1 and 2 as being spaced below the top 15 of basement wall 10. Siding material in the form of siding strips 42 is fastened to the building after insulation members 20 and strip 21 have been installed. Siding 42, shown in FIGS. 1 and 2, extends down over the top portion of strips 21 and 24 so that siding 42 covers insulation sheets 20 located above strip 21 and 24 while the ground cover will cover the lower edges of strips 21 and 24 together with insulation sheets 20 located below strip 21 and 24.

The window embodiment shown in FIGS. 4 and 5 corresponds in most respects to the insulated basement window assembly illustrated in FIGS. 1 and 2; however, in FIGS. 4 and 5, window opening 50 is located at the top 15 of basement wall 51 as opposed to being spaced below the top 15 of basement wall 10, as shown in FIG. 2.

Wood form 52, which corresponds to wood form 16, is positioned in opening 51 with wood member 53 being positioned below joist 55.

Panel 22 is positioned relative to window opening 50 in the same manner as previously described for the window assembly embodiment shown in FIGS. 1 and 2; however, the pre-cut panel opening is located a distance "A", FIG. 3, which is smaller than the "A" distance for the panel opening location in the panel used in the window assembly embodiment of FIGS. 1 and 2.

The window unit employed for the embodiment of FIGS. 4 and 5 is substantially the same as used in the embodiment of FIGS. 1 and 2, except that the window panel unit shown in FIGS. 4 and 5 includes a plastic flashing fin 56 which is integral with and projects outwardly from plastic flange 31. Fin 56 includes a bottom leg 57 and a vertical leg 58. As seen in FIGS. 4 and 5, upon installation, the bottom portion of siding strip 42, including leg or lower edge 61, is adapted to fit within the recess formed by flashing fin legs 57, 58. This assures the desired trim at the area of the window location.

Once the basement window assembly of the present invention has been completed, the grade can be filled in along the building to cover the insulation material 20 located below impact resistant strip 21. Window wells 60 are fashioned around window unit 30 as shown in FIGS. 1 and 4.

While the insulated window assembly embodiments shown in FIGS. 1 and 3 utilize pre-fabricated panels 22, it is appreciated that the window assemblies could be completed by the use of an insulation member and impact resistant strip which are neither pre-cut nor pre-assembled. However, it has been found that the utilization of pre-fabricated panel 22 with its pre-cut window opening serves to reduce the time for installing a window assembly of the present invention at the job site.

Moreover, it has been found that the positioning of window units 30 adjacent the outer basement wall so that the dual panes of acrylic safety glazing are located in substantially vertical alignment with the insulating members 20 provides a window shelf 80 and preserves the insulating envelope, while eliminating the conventional snow-collecting, water generating exterior window sill.

Further, the thickness of window units 30 is relatively small and the units are relatively light so that installation can easily be made in the field. In one application, the insulation member 20 is approximately 1" thick while the thickness of the impact resistant strip 21 is about $\frac{1}{8}$". The thickness of window unit 30 is approximately $1\frac{1}{8}$".

Finally, reference has been made to an insulating material 20 used in conjunction with an impact resistant strip 21 and 24. In some applications, it may not be necessary to employ strip 21 and 24, inasmuch as the particular insulating member will be adequate for the particular application.

The foregoing detailed description has been given for clearness of understanding only, and no unnecessary limitations should be understood therefrom, as modifications will be obvious to those skilled in the art.

What we claim is:

1. An insulating, substantially leak-free window assembly adapted for use with a window opening in a masonry basement wall of a building having an inner and outer wall, the assembly comprising:

an insulating member affixed to the outer basement wall at the location of the window opening, said member having an opening therein aligned with said opening in the basement wall;

a window unit, which serves as an insulating membrane, said unit being seated in said basement window and insulating member openings; said window unit having a frame which includes a flange which extends out from said frame, said flange being seated against said insulating member; thereby seating said window unit in said opening free from contact with said outer wall and, fastening means for fastening said window unit in said openings whereby said flange seats against said insulating member whereby heat losses between said inner and outer wall at the location of said window unit are reduced.

2. A window assembly in accordance with claim 1 and further including an impact resistant strip disposed on said insulating member, said strip having an opening therein which is aligned with said opening in said insulating member.

3. A window assembly in accordance with claim 2 wherein said insulating member and impact resistant strip are joined to each other and are pre-cut to form a pre-fabricated panel.

4. A window assembly in accordance with claim 1 and further including a means for sealing the space between said window unit flange and said insulating member, said sealing means being located between said flange and said insulating member.

5. A window assembly in accordance with claim 4 wherein said opening in said masonry basement wall has a wooden form about the perimeter of said opening and said fastening means are fastened to said wood form for seating said window unit against said insulating member.

6. A building having a masonry basement wall, comprising inner and outer and top walls and including at least one opening in said basement wall for receipt of an insulating window membrane assembly, said assembly comprising;

an insulating member fixed to said outer basement wall and having an opening therein substantially aligned with the opening in said basement wall;

an impact resistant strip joined to said insulating member and having an opening in said strip which is aligned with the opening in said basement wall;

a window unit means for serving as an insulating membrane, seated within said openings;

said window unit having a means adapted to seat against an impact resistant strip on the outer insulation surface; and fastening means for fastening said window unit at said seating means to said basement wall whereby said window unit is anchored in place against said strip to serve as an insulating means at the location of said opening in said basement wall and said window unit is insulated from contact with said outer wall by said insulating material.

7. The insulated basement window assembly of claim 6 wherein said basement wall includes a plurality of said window assemblies.

8. The insulated window assembly of claim 6 wherein said insulating member and impact resistant strip are joined together to form an integral pre-fabricated panel having an opening therein.

9. The window assembly of claim 6 wherein said window unit means is plastic and includes a frame having double panes of spaced glazing and said seating means comprises a flange which extends outward from said frame.

10. The window assembly of claim 9 wherein said frame further includes a flashing fin means which projects outward from said frame for receiving the bottom portion of a siding strip used to side a building frame.

11. The window assembly of claim 6 wherein said basement wall opening has a wooden form disposed about the perimeter of said basement window opening.

12. The window assembly of claim 6 and further including sealing means for sealing the spacing between said strip and said window unit flange means.

13. An insulating, substantially leak-free window assembly adapted for use with a window opening in a masonry basement wall assembly having masonry on the interior and rigid foam insulation on the exterior, said window unit, which serves as an insulating membrane, being seated in said rigid foam insulation instead of the masonry wall, said window unit having a plastic frame which includes a flange which extends out from said frame, said flange being seated against said rigid foam insulation or an impact resistant strip disposed against the exterior surface of said insulation thereby seating said window unit in said opening free from direct contact with the exterior of said masonry wall; and, fastening means for fastening said window unit in said opening whereby said flange seats against either said insulation or said impact resistant strip and resists the passage of water through said window opening.

* * * * *